United States Patent [19]

Gonnet et al.

[11] Patent Number: 4,775,420

[45] Date of Patent: Oct. 4, 1988

[54] COMPLEX PIGMENT COMPOSITIONS FOR COATING OF PAPER

[75] Inventors: Olivier Gonnet, Saint-Andre-De-Corcy; Jean Vallas, Caluire, both of France

[73] Assignee: Coatex, S.A., Caluire, France

[21] Appl. No.: 31,589

[22] Filed: Mar. 30, 1987

[30] Foreign Application Priority Data

Aug. 22, 1986 [FR] France ..... 86 12099

[51] Int. Cl.[4] ..... C08J 3/10

[52] U.S. Cl. ..... 524/431; 524/447; 524/451; 524/437; 524/438; 524/425; 106/501; 106/447

[58] Field of Search ..... 106/308 M, 211, 300; 524/431, 438, 447, 451

[56] References Cited

U.S. PATENT DOCUMENTS

| | | | |
|---|---|---|---|
| 4,062,692 | 12/1977 | Hemmerich et al. | 106/300 |
| 4,244,863 | 1/1981 | Hemmerich et al. | 524/431 |
| 4,395,499 | 7/1983 | Rosenski et al. | 524/447 |
| 4,429,074 | 1/1984 | Mishiba et al. | 524/447 |

FOREIGN PATENT DOCUMENTS 59-193964 4/1983 Japan .

*Primary Examiner*—Paul Lieberman
*Assistant Examiner*—Christine A. Skane
*Attorney, Agent, or Firm*—Oblon, Fisher, Spivak, McClelland & Maier

[57] ABSTRACT

Complex pigment compositions for the coating of paper, comprising an aqueous phase, at least one pigment of mineral origin, a binding agent, optionally various customary additives, and a dispersing agent comprised of carboxyl-containing polymers which are water soluble and are converted to form salts. The polymers are obtained by known polymerization processes. The dispersing agent (a) has a specific viscosity (measured on the sodium salt) of between 0.25 and 2; and (b) is converted to the salt form to the extent of at least 60% by at least one salt-forming agent which has a polyvalent function.

These complex pigment compositions have very low viscosities. They may also simultaneously contain diverse pigments, such as kaolin, titanium dioxode, and calcium carbonate, without suffering the usual increase in viscosity and the risk of setting.

17 Claims, 4 Drawing Sheets

COMPLEX PIGMENT COMPOSITIONS FOR COATING OF PAPER

BACKGROUND OF THE INVENTION

1. Field of the Invention

The invention relates to complex pigment compositions for the coating of paper, containing a high concentration of one or more pigments having a viscosity which is low and is stable with time.

2. Discussion of the Background

Those skilled in the art have for a long time had available pigment compositions for the coating of paper. These compositions contain pigments, ordinarily of a known type such as kaolin, comprised of more or less substantial quantities of clays, an aqueous phase in which the pigments are dispersed, a binding agent of natural origin which may be water-dispersed or water-soluble (e.g. starch, casein, or carboxymethylcellulose), and/or a synthetic binding agent (e.g. styrene/butadiene emulsions, styrene/acrylate emulsions, or vinyl copolymer emulsions), and a dispersing agent (e.g. a polyphosphate).

There has been rapid development in paper coating techniques due to advancement of the relevant techniques and improvement in coating speeds. As a result, there has come about a requirement that pigment compositions for coating paper must also contain the minimum possible amount of water, in order to reduce the heat energy consumed in drying, and in order to attain the most favorable rheological characteristics for the coating operation. These characteristics are a low viscosity and high velocity gradient, so that coating can be accomplished very rapidly; or to enable low shear stress via an always-low viscosity, for easy handling of the coating composition, particularly during sieving operations prior to the coating operation.

Pigment compositions for the coating of paper have themselves undergone major evolution in recent years in response to technical progress (major increases in coating speed) and to needs relating to productivity, quality, and cost. Beside the reduction of the amount of water, improvements have come in the form of increased concentration of the pigment materials, and particularly in the use of alkali metal or ammonium polyacrylates as dispersants. This enables pigments to be maintained in a dispersed state, after being mechanically comminuted, so that the coating composition is sufficiently fluid.

In this connection, French Patent No. 2,185,721 describes pigment compositions for coating paper, wherein the dispersant is chosen from the acrylic acid polymers completely neutralized by an alkaline sodium hydroxide solution. However, such dispersants have major disadvantages in that they have been found to be difficult to use in certain pigment compositions currently used for coating paper. In particular, they have been shown to be sensitive to pH variation in the aqueous phase of the pigment dispersion in the ionic environment of the compositions, resulting in rapid and irreversible increases in viscosity, and in some cases bulk setting of the coating composition.

The pigment compositions for the coating of paper which are presently available have advanced pigment formulations. They increasingly often employ mixtures of pigments which are no longer comprised solely of kaolin or of kaolin and clays, but are comprised of kaolin and/or pigmented calcium carbonate and/or talc and/or titanium dioxide, whereby the ionic state of the aqueous phase is changed. Accordingly, the abovementioned increases in viscosity (and in certain cases the abovementioned setting) occur during preparation of these pigment compositions and during mixing of the pigment compositions prior to their being applied to coat paper and/or being stored. In particular, these adverse phenomena occur in the case of mixtures of pigments.

Thus, the known dispersants as employed are incapable of eliminating the problems caused by the presence of mixtures of pigments which are more or less compatible with each other, in the pigment compositions for coating paper. Nonetheless, these mixtures are required in the compositions for reasons of improving the quality of the paper after coating.

The present Applicant, in another area of technology, had previously encountered the phenomenon of viscosity increase during crushing and grinding of mineral materials in aqueous medium, and had successfully proposed the use of a "comminution agent", a ethylenic polymer. This enabled the concentration of mineral matter in the suspension fed to the crushing and grinding operation to be increased, while maintaining a low viscosity which was stable with time during the comminution and the prolonged (1 month) storage of the suspensions of comminuted materials.

In this connection, French Patent No. 2,531,444 describes a comminution agent comprised of a polymer and/or copolymer of ethylenic acids, wherein the acid functions are partially neutralized by at least one neutralizing agent having at least one monovalent function, wherewith the degree of neutralization may be between 0.40 and 0.96, preferably between 0.50 and 0.75. Here the nature of the neutralizing cation is not essential. Rather, the important characteristic is the amount of free acidity following the neutralization.

However, when this comminution agent is introduced into a pigment composition comprised of a high concentration of pigments (e.g. 70%) comprising a single pigment (e.g. kaolin) or a plurality of pigments (e.g. pigmented calcium carbonate and titanium dioxide) for coating paper, the comminution agent causes a substantial increase in the viscosity and indeed in certain extreme cases it causes the composition to set, even though one would expect just the opposite, i.e., a lowering of the viscosity, based on the behavior of the polymeric agent as a comminution agent.

French Patent No. 2,539,137 describes a comminution agent comprised of a polymer and/or copolymer of ethylenic acids, wherein the acid functions are completely and simultaneously neutralized by at least one neutralizing agent having a monovalent function and at least one other neutralizing agent having a polyvalent function. The monovalent-type neutralizing agent comprises between 40 and 95%, preferably between 60 and 90%, and the polyvalent-type neutralizing agent comprises between 60 and 5%, preferably between 40 and 10% of the total neutralizing agent.

However, when this comminution agent is employed as a dispersant in pigment compositions for coating of paper according to the prior art method, the compositions comprising a very high concentration of one pigment (e.g., kaolin, such as "Dinkie A lump", at a concentration of 68%) or of a mixture of a plurality of pigments (e.g., calclum carbonate and titanium dioxide), a rapid and irreversible change of the rheological characteristics of the compositions occurs. In particular a substantial increase in viscosity occurs, and in certain cases bulk setting, particularly in the case of a mixture of pigments, even if it is a mixture of two pigments with one present in a very small proportion.

SUMMARY OF THE INVENTION

Accordingly, the object of the invention is to remedy the disadvantages described above, by providing complex pigment compositions for coating paper, in which a dispersant is introduced which provides a viscosity which is low and is stable with time, and which also provides excellent compatibility of the pigments and prevents setting.

This object and other objects which will become apparent from the following specification have been achieved by the complex pigment compositions for coating paper of the present invention, comprising an aqueous phase, at least one pigment of mineral origin, a binding agent, and further comprising a dispersing agent comprised of carboxyl-containing polymers which are water soluble and are converted to form salts, wherein the dispersing agent:

(a) has a specific viscosity (measured on the sodium salt) of between 0.25 and 2; and (b) is converted to the salt form to the extent of at least 60% of the carboxyl groups by at least one salt forming agent which has a polyvalent function.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
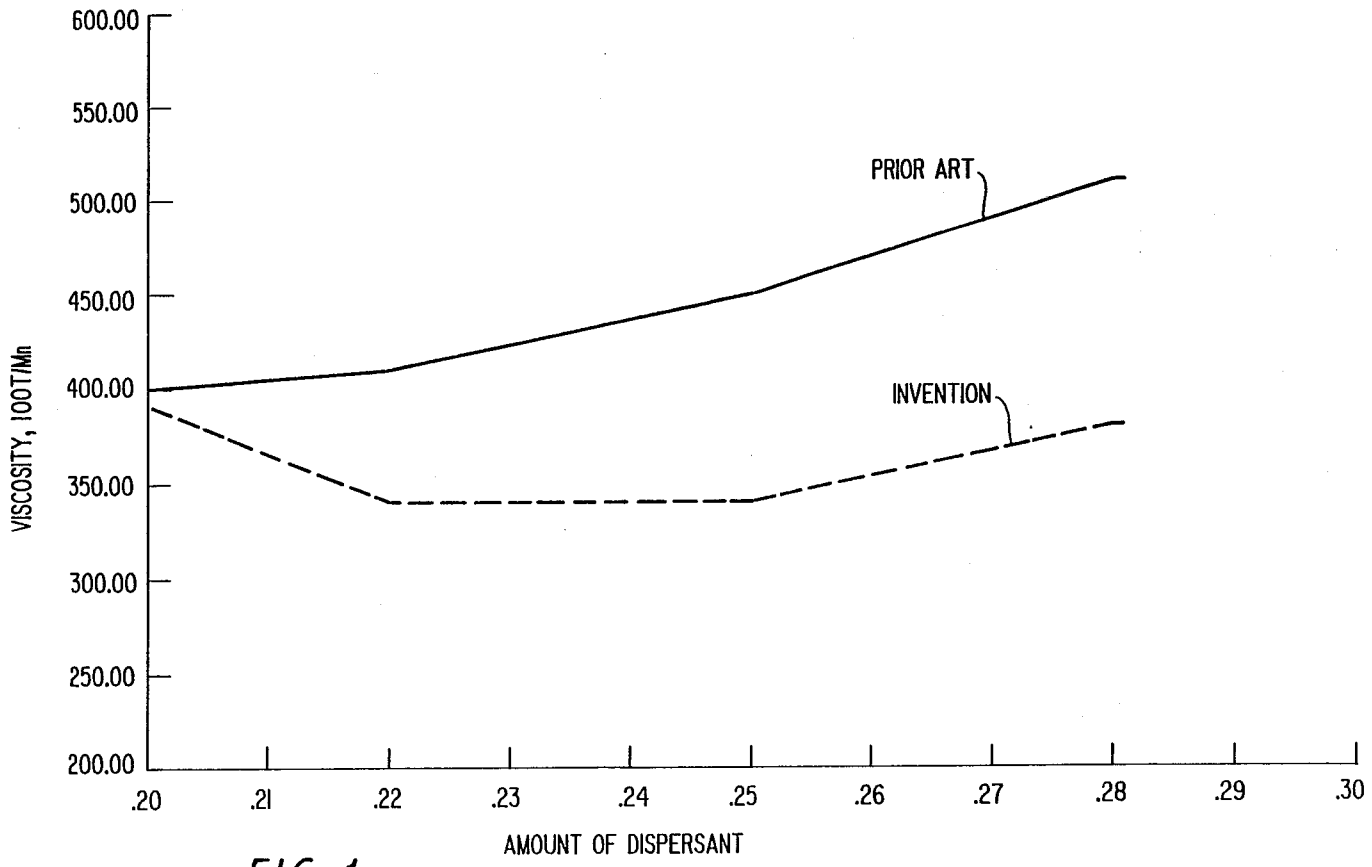
FIG. 1 shows the viscosity behavior of pigment compositions at a constant pH value with respect to increasing amounts of dispersant.

To better understand the invention, one should recall that a polyvalent salt-forming agent has the ability to associate with as many carboxyl functions of the polymer as its cation has valences.

Also, to indicate all the importance and value of the invention, it is useful to specify that the term "complex pigment compositions" is understood to mean pigmented formulations containing a pigment at a higher concentration than in the prior art, or containing a mixture of a plurality of pigments the incompatibility of which is clearly evidenced in the presence of a dispersant of the prior art type.

Among the pigments employed alone or in mixtures withi the scope of the invention, are kaolins, titanium oxides, talcs, natural or precipitated carbonates, aluminum hydroxides, satin white (hydrated double sulfate of aluminum and calcium), and natural or synthetic gypsums.

Research was conducted into dispersants for pigment compositions for the coating of paper, and numerous industrial tests were carried out, whereby it was observed and later verified that it is possible to devise pigment compositions which have higher concentrations of dry matter than have been attained according to the prior art. These compositions are of complex formulation, employing mixtures of pigments, and have a viscosity which is low and is very stable with time, and accordingly, these compositions do not set.

These conditions are achieved when the dispersant is a water-soluble carboxyl-containing polymer wherein at least 60% of the carboxylic functions are salts of an appropriate salt-forming agent which has a polyvalent function, wherewith at least 60% of the carboxylate salt groups are formed with the agent. In contrast, the polymer would cause the viscosity of the pigment composition to increase and in some cases would cause them to set, if unconverted or particularly if converted to the salt form entirely with a monovalent salt-forming agent, and if used in unconverted or monovalently converted form as a dispersant in complex pigment compositions for coating paper.

The carboxyl-containing polymers comprising the dispersant of the present invention result from polymerization in the presence of transfer agents, according to known methods, in aqueous medium, or in alcohol or water-alcohol or aromatic or aliphatic medium, of at least one of the following monomers: (meth)acrylic acid, itaconic acid, crotonic acid, fumaric acid, maleic anhydride, isocrotonic acid, aconitic acid, mesaconic acid, sinapic acid, undecylenic acid, angelic acid, and hydroxyacrylic acid.

The carboxyl-containing polymer may also contain at least one of the following comonomers: acrolein, acrylamide, acrylonitrile, esters of (meth)acrylic acid (in particular, methyl (meth)acrylate, ethyl (meth)acrylate, propyl (meth)acrylate, and dimethylaminoethyl (meth-)acrylate), imidazoles, vinylpyrrolidone, vinylcaprolactam, ethylene, propylene, isobutylene, diisobutylene, vinyl acetate, styrene, alpha-methylstyrene, and methyl vinyl acetone.

The transfer agents employed in the polymerization are those well known in the art, e.g. isopropanol, tertiary dodecylmercaptan, thioglycolic acid and its esters, n-dodecylmercaptan, 2-mercaptopropionic acid, and thiobisethanol.

The polymerization medium may be water, methanol, ethanol, propanol, isopropanol, one or more of the butanols, dimethylformamide, dimethylsulfoxide, tetrahydrofuran, acetone, methyl ethyl ketone, ethyl acetate, butyl acetate, hexane, heptane, benzene, toluene, xylene, acetic acid, tartaric acid, lactic acid, citric acid, gluconic acid, glucoheptonic acid, halogenated solvents (such as carbon tetrachloride, chloroform, dichloromethane, or chloromethane), ethers of ethylene glycol, and ethers of propylene glycol.

The water-soluble carboxyl-containing polymers according to the invention generally have a specific viscosity (measured on the sodium salt) which is preferably between 0.30 and 1.0.

The specific viscosity, $\eta$, of the carboxyl-containing polymers and/or copolymers is determined as follows:

A solution of the 100% neutralized carboxyl-containing polymer and/or copolymer (neutralized by sodium hydroxide for the purposes of this measurement) is prepared by dissolving 50 g of the dry polymer and/or copolymer in 1 liter of a solution of 60 g NaCl in distilled water. Then, using a capillary viscometer with a Baume constant of $1.05\times10^{-4}$ placed in a thermostat bath at 25° C., the time of outflow of a given volume of the solution containing the alkaline carboxyl-containing polymer and/or copolymer is measured, as well as the time of outflow of the same volume of aqueous NaCl solution without the polymer and/or copolymer. The specific viscosity is then defined as follows:

$$\eta = \frac{\text{(outflow time of the polymer solution)} - \text{(outflow time of the NaCl solution)}}{\text{(outflow time of the NaCl solution)}}$$

The capillary tube is ordinarily chosen such that the outflow time of the NaCl solution without the polymer and/or copolymer is about 90–100 sec, at which point the measurement of the specific viscosity is very precise.

The salt-forming agent having a polyvalent function is chosen from among the group of compounds having at least one divalent alkaline-earth cation, in particular calcium, magnesium, zinc, copper, or lead cations, and the group of compounds having at least one trivalent cation, in particular, aluminum and chromium cations, and the group of compounds having at least one of the cations of higher valence.

The degree of salt-forming of the dispersant according to the invention by at least one salt-forming agent having a polyvalent function may be between 60% and 100% inclusive.

After the salts are formed with at least 60% of the acid sites by at least one salt-forming agent having a polyvalent function, the remaining acid sites may be maintained in the acid state or may be converted to salts according to the prior art, i.e., using a salt-forming agent having a monovalent function, e.g., an alkali cation, in particular a cation of lithium, sodium, or potassium, or similarly ammonium or a quaternary amine.

The dispersant is introduced into the pigment compositions at a concentration of 0.1–1.5 wt. %, preferably 0.15–1.0 wt. % based on the weight of the dry pigments.

In addition to the dispersant, the compositions are comprised of pigments, alone or in mixtures, chosen from among those known in the art (e.g., kaolin, calcium carbonate, talc, titanium dioxide, and aluminum hydroxide).

The pigment compositions according to the invention are also comprised of at least one binder and/or water retention agent, chosen from among the binders of natural or synthetic origin, e.g. natural-type binders such as starch, carboxymethylcellulose, and polyvinyl alcohol, all used in aqueous solution and serving simultaneously as water retention agents, and synthetic-type binders such as styrene-butadiene copolymers or styrene-acrylate copolymers, with all of these copolymers being employed in aqueous emulsion.

The binder and/or water retention agent is introduced in the pigment compositions according to the invention in the amount of 7–20 wt. % based on the weight of dry pigments.

The pigment compositions according to the invention may also contain the usual additives, in known fashion, e.g. antifoaming agents, bluing agents, biocides, colorants, alkaline hydroxides, etc.

The usual additives are introduced in the pigment compositions according to the invention in the amounts required in each specific case to obtain the desired formulation properties. These effective amounts are known in the art.

In practice, the pigment compositions according to the invention may contain the following ingredients (figures given are wt. % with respect to the dry, anhydrous mineral pigment component):

(a) Dispersant, in the amount of 0.10–1.5%, preferably 0.15–1.0%;

(b) Binder and/or water retention agent, in the amount of 7–20%;

(c) Optionally, usual additives, in the known amounts.

The pigment compositions are prepared according to methods known in the art.

The pigment compositions according to the invention represent substantial advances over the prior art in the technical area of paper coating, for the reasons that they contain a complex pigment formulation (mixture of pigments), at a high concentration, and they have optimal rheological characteristics for the coating operation, namely low viscosity under high velocity gradients, as well as having optimal rheological characteristics for the materials handling operations such as sieving and pumping, i.e., low viscosities and low shear stresses are maintained.

Other features of the invention will become apparent in the course of the following descriptions of exemplary embodiments which are given for illustration of the invention and are not intended to be limiting thereof.

EXAMPLES

EXAMPLE 1

The object of this Example is to illustrate differences in characteristics between the invention and the prior art.

Pigment compositions for the coating of paper were prepared by known methods. One such group of compositions was prepared using known dispersants, and another such group was prepared using dispersants according to the invention.

In a first set of tests (Tests 1 and 2), for a given pH traditionally used in the paper industry, the optimal concentration interval of the dispersant in the compositions was determined so as to yield a very low, constant viscosity.

In Test 1, pigment compositions were used wherein the pigment, Dinkie A lump kaolin (supplied by the firm English China Clay, of Great Britain) was suspended in the amount of 71 wt. % in water (based on the total weight of the suspension) in the presence of increasing amounts of sodium polyacrylate (100% converted to salt form, with specific viscosity 0.4), which is a dispersant representing the prior art.

In Test 2, pigment compositions were used wherein the same pigment suspension was used but in the presence of increasing amounts of an acrylic polymer with specific viscosity 0.4 (converted to salt form in the amount of 70% by $Ca^{+2}$ and in the amount of 30% by $Na^{+}$), which is a dispersant according to the invention.

The pH of the compositions was controlled at 7.4±0.1.

The Brookfield viscosities of all these pigment compositions were measured at 10 and 100 rpm and at forces appropriate to the viscosities. The viscosities were measured with the aim of devising the optimum preparation.

All the results for these compositions are presented in Table 1 and FIG. 1.

TABLE I

| Test No. | Rpm of Brookfield viscometer | Tabulated data are Brookfield viscosities (centipoise) Amount of dispersant used, dry wt. % (based on dry weight of pigments) 0.20% | 0.22% | 0.25% | 0.28% |
|---|---|---|---|---|---|
| Test 1 | 10 T/mn | 1,100 | 1,200 | 1,400 | 1,800 |
| Prior Art | 100 T/mn | 400 | 410 | 450 | 510 |
| Test 2 | 10 T/mn | 1,100 | 900 | 980 | 1,000 |
| Invention | 100 T/mn | 390 | 340 | 340 | 380 |

Table 1 shows that, at equal concentrations of the dispersants:

(a) the viscosity of the pigment compositions is always lower with the dispersant according to the invention;

(b) the viscosity of pigment compositions according to the invention does not change between dispersant concentrations of 0.22 and 0.25 wt. % (dry weight basis), which is the most favorable use interval. At the same time, the viscosity of prior art compositions increases with the amount of dispersant.

In a second group of tests (Tests 3 and 4), a pH interval was studied for a given concentration of dispersant, which corresponds to the pH of components used in the paper industry for preparing coating compositions.

It is known that the pH of kaolin coating-compositions used in the prior art is controlled at about 7.3, which is the value at which the viscosity is the lowest. It is further known that adjusting the pH of the various components of the coating compositions avoids shocks resulting from pH differences, which are manifested as an undesirable increase in viscosity.

Test 3 concerns pigment compositions containing Dinkie A lump kaolin suspended in the amount of 71 wt. % in water (based on the total weight of the suspension) in the presence of the same sodium polyacrylate (100% converted to salt form) as was used in Test 1. The polyacrylate is a dispersant according to the prior art, the dispersant being present in the compositions in the amount of 0.25 wt. % (dry weight basis, based on the weight of the pigments). The pH of the compositions ranged from 7.35 to 10.25.

Test 4 concerns pigment compositions containing Dinkie A lump kaolin suspended in the amount of 71 wt. % in water (based on the total weight of the suspension) in the presence of the same (calcium/sodium) polyacrylate as was used in Test 2. The polyacrylate is a dispersant according to the invention, the dispersant being present in the said compositions in the amount of 0.25 wt. % (dry weight basis, based on the weight of the pigments). The pH of the compositions ranged from 7.35 to 10.25.

The Brookfield viscosities of these pigment compositions (Tests 3 and 4) were measured as per Tests 1 and 2.

Figure 2:
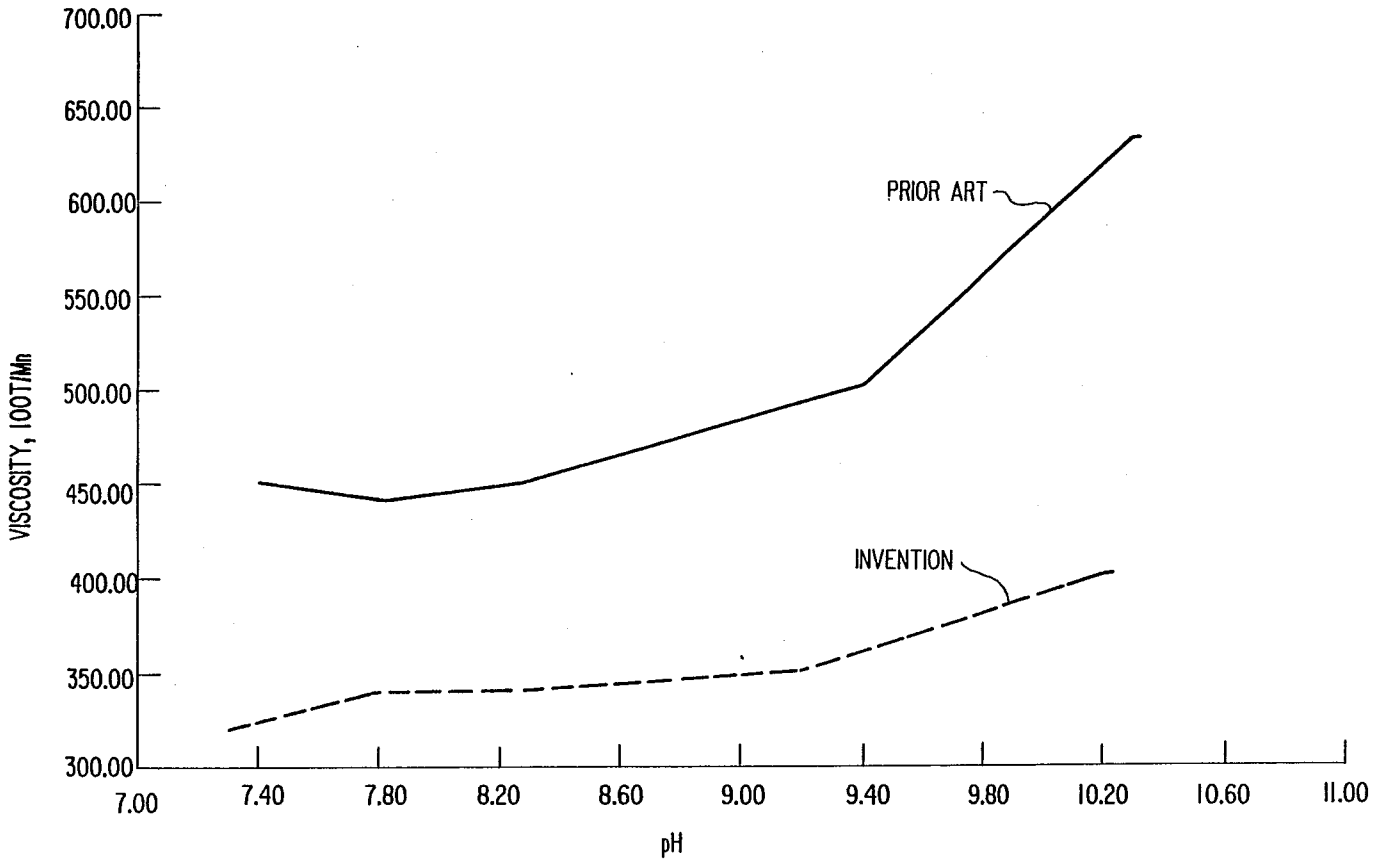
FIG. 2 shows the viscosity behavior of pigment compositions at varying pH values for a given concentration of dispersant.

All the results for these compositions are presented in Table II and FIG. 2.

Table II reveals that, for increasing pH of the given pigment compositions with the same concentration of the respective dispersants:

(a) the viscosity of the compositions according to the invention is always less than that of the compositions according to the prior art, regardless of pH; and (b) the viscosity of the compositions according to the invention is stabile regardless of pH, while the viscosity of the prior art compositions increases with pH.

TABLE II

| Test No. | Rpm of Brookfield viscometer | Tabulated data are Brookfield viscosities (centipoise) pH 7.35 | 7.8 | 8.3 | 9.3 | 10.25 |
|---|---|---|---|---|---|---|
| Test 3 | 10 T/mn | 1,400 | 1,400 | 1,500 | 1,750 | 2,350 |
| Prior Art | 100 T/mn | 450 | 440 | 450 | 500 | 630 |
| Test 4 | 10 T/mn | 940 | 950 | 950 | 1,000 | 1,360 |
| Invention | 100 T/mn | 320 | 340 | 340 | 350 | 400 |

EXAMPLE 2

The purpose of this Example is to illustrate the invention. The Example concerns preparation of pigment compositions for the coating of paper, using dispersants comprising acrylic polymers having specific viscosities (measured on the sodium salts) in the preferred range of 0.3 to 1, in which the polymers have been converted to the salt form to the extent of at least 60% by at least one salt-forming agent having a divalent function.

Comparative Test 5 concerns a pigment composition for coating paper, comprised of titanium dioxide ("Anatase", supplied by Thann et Mulhouse) in the amount of 72 wt. % (based on the total weight of the composition), in the presence of dispersants in the amount of 0.35 wt. % (based on the weight of pigment), the dispersants being namely acrylic polymers completely converted to the salt form by sodium ions as per the prior art.

Tests 6–24 concern pigment compositions for coating paper as per Test 5 but with the dispersants being acrylic polymers converted to the salt form to the extent of at least 60% by a salt-forming agent having a divalent function (see Table III).

The Brookfield viscosities of all these pigment compositions (Tests 6–24) were measured at 10 and 100 rpm and at forces appropriate to the viscosities. The viscosities were measured with the aim of devising the optimum preparation.

Further, in order to demonstrate the possible adverse effects produced in industrial installations, in particular in piping, pumps, and storage tanks, by successive passage of different compositions through such installations, e.g. one based on calcium carbonate and the other on titanium dioxide, the two compositions were tested in the laboratory for their compatibility. The test consisted of the following.

A very small quantity (1 wt. % based on the weight of the $TiO_2$) of an aqueous suspension of finely ground calcium carbonate ("H-90", supplied by Omya France) was introduced into a pigment composition based on titanium dioxide, with the concentration of the calcium carbonate in the aqueous calcium carbonate suspension being 75 wt. % (based on the total weight of the suspension). The changes in viscosity of the pigment composition were observed which could lead to setting.

All the parameters and results with respect to the above-described compositions are given in Table III.

TABLE III

| Test No. | Dispersant (acrylic polymer) Specific Viscosity | Salt-forming agent | Degree of conversion to salt form (1 = 100%) | Pigment Compositions comprising titanium dioxide ("Anatase", supplied by Thann et Mulhouse) in the amount of 72 wt. % of the total weight of the pigment composition. Viscosity (centipoise) At 10 rpm (of viscosimeter) | At 100 rpm (of viscosimeter) | Compatibility with calcium carbonate |
|---|---|---|---|---|---|---|
| Test 5 Prior Art | 0.40 | $Na^+$ | 1 | Not measurable (composition too thick) | | Setting |
| Test 6 Invention | 0.40 | $Ca^{2+}$ | 1 | 2,200 | 385 | No increase in viscosity |
| Test 7 Invention | 0.40 | $Ca^{2+}/Na^+$ | 0.70/0.3 | 3,800 | 650 | No increase in viscosity |
| Test 8 Prior Art | 0.40 | $Ca^{2+}/Na^+$ | 0.55/0.45 | Thick, of pasty consistency | | No increase in viscosity |
| Test 9 Invention | 0.40 | $Mg^{2+}$ | 1 | 4,500 | 750 | Viscosity increase less than 20% |
| Test 10 Invention | 0.40 | $Mg^{2+}/Na^+$ | 0.7/0.3 | 12,200 | 1,380 | Viscosity increase less than 20% |
| Test 11 Invention | 0.40 | $Mg^{2+}/Na^+$ | 0.6/0.4 | 24,000 | 3,200 | Viscosity increase less than 20% |
| Test 12 Invention | 0.55 | $Ca^{2+}$ | 1 | 1,400 | 250 | No increase in viscosity |
| Test 13 Invention | 0.55 | $Ca^{2+}/Na^+$ | 0.70/0.3 | 2,600 | 450 | No increase in viscosity |
| Test 14 Invention | 0.55 | $Ca^{2+}/Na^+$ | 0.6/0.4 | 5,400 | 875 | No increase in viscosity |
| Test 15 Invention | 0.55 | $Mg^{2+}$ | 1 | 1,900 | 345 | No increase in viscosity |
| Test 16 Invention | 0.55 | $Mg^{2+}/Na^+$ | 0.7/0.3 | 2,650 | 455 | No increase in viscosity |
| Test 17 Invention | 0.55 | $Mg^{2+}/Na^+$ | 0.6/0.4 | 2,700 | 470 | No increase in viscosity |
| Test 18 Invention | 0.70 | $Ca^{2+}$ | 1 | 1,600 | 310 | No increase in viscosity |
| Test 19 Invention | 0.70 | $Ca^{2+}/Na^+$ | 0.765/0.235 | 2,000 | 350 | No increase in viscosity |
| Test 20 Invention | 0.70 | $Ca^{2+}/Na^+$ | 0.7/0.3 | 2,500 | 440 | No increase in viscosity |
| Test 21 Invention | 0.70 | $Ca^{2+}/Na^+$ | 0.6/0.4 | 3,450 | 600 | No increase in viscosity |
| Test 22 Invention | 0.70 | $Mg^{2+}$ | 1 | 2,000 | 410 | No increase in viscosity |
| Test 23 Invention | 0.70 | $Mg^{2+}/Na^+$ | 0.7/0.3 | 2,400 | 435 | No increase in viscosity |
| Test 24 Invention | 0.70 | $Mg^{2+}/Na^+$ | 0.6/0.4 | 2,650 | 455 | No increase in viscosity |

By comparison of Test 5 with Tests 6–24, Table III shows the following:

(a) the major decrease in viscosities of the pigment compositions, which are only down into the measurable range with the inventive dispersant, and are beyond measurability with the prior art dispersant. The pigments may be used at the given concentration (72 wt. %) with the invention, but not with the prior art;

(b) the very beneficial influence of conversion of the dispersants to salts with at least 60% of the carboxyl groups converted to salt form by means of a polyvalent salt-forming agent; and (c) the high compatibility of the pigments studied ("Anatase" $TiO_2$ and calcium carbonate), for the pigment compositions according to the invention.

EXAMPLE 3

The object of this Example is to demonstrate the universal character of the invention for the use of pigment compositions comprising titanium dioxide of diverse origins.

For this purpose, pigment compositions for coating paper, in which the pigment comprises titanium dioxide (namely "AHR", supplied by Tioxide, for Tests 25–27; and "$TiO_2$ A", supplied by Kronos, for Tests 28–30), were prepared by known methods. The pigment was suspended in water in the amount of 72 wt. % of the weight of the suspension, and was used in the presence of a dispersant which was either:

(i) a sodium polyacrylate (specific viscosity 0.4; degree of conversion to salt form=100%), for the tests representing the prior art (Tests 25-6, 28-9); or (ii) an acrylic polymer (specific viscosity 0.4) which had been converted to salt form to the extent of 70% of the carboxyl groups by $Ca^{++}$ and to the extent of 30% of the carboxyl groups by $Na^+$, for the tests representing the invention (Tests 27 and 30).

The viscosities were measured and the compatibilities were tested, in the same manner as in Example 2, for all the pigment compositions.

All the results with respect to the abovedescribed compositions are given in Table IV.

TABLE IV

| Test No. | Type of Titanium Dioxide | Dispersant (acrylic polymer) Salt-forming agent | Degree of conversion to salt form (1 = 100%) | Amount of dispersant (dry wt. % based on dry weight (of pigment | Pigment Compositions comprising titanium dioxide in the amount of 72 wt. % of the total weight of the pigment composition. Viscosity (centipoise) At 10 rpm (of viscometer) | At 100 rpm (of viscometer) | Compatability with calcium carbonate |
|---|---|---|---|---|---|---|---|
| Test 25 Prior Art | "AHR" Supplied by the firm Tioxide | $Na^+$ | 1 | 0.1 | 2,750 | 520 | Setting or congealing |
| Test 26 Prior Art | "AHR" Supplied by the firm Tioxide | $Na^+$ | 1 | 0.35 | 14,600 | 2,700 | Setting or congealing |
| Test 27 Invention | "AHR" Supplied by the firm Tioxide | $Ca^{2+}/Na^+$ | 0.7/0.3 | 0.35 | 3,400 | 610 | No increase in viscosity |
| Test 28 Prior Art | "A" Supplied by the firm Kronos | $Na^+$ | 1 | 0.1 | Thick, of pasty consistency | | Setting or congealing |
| Test 29 Prior Art | "A" Supplied by the firm Kronos | $Na^+$ | 1 | 0.35 | Thick, of pasty consistency | | Setting or congealing |
| Test 30 | "A" Supplied by the firm Kronos | $Ca^{2+}/Na^+$ | 0.7/0.3 | 0.35 | 2,450 | 440 | No increase in viscosity |

Table IV confirms the conclusions drawn from Table III of Example 2, which particularly favor the invention.

EXAMPLE 4

This Example enables the universal character of the invention to be illustrated by employing kaolin in the pigment compositions, the kaolin being used as an example of pigments of different origin than the pigment used in Example 1.

For this purpose, pigment compositions for the coating of paper were prepared by known methods, which were based on the kaolin "Alphacoat" (supplied by Anglo American Clays Corp.) plus a dispersant, one composition with a dispersant representing the prior art, and one with a dispersant according to the invention.

Test 31 concerns pigment compositions comprised of "Alphacoat" kaolin suspended in water in the amount of 68 wt. % kaolin (based on the total weight of the suspension), plus a dispersant according to the prior art, namely a sodium polyacrylate (specific viscosity 0.4) introduced into the compositions in a series of increasing amounts expressed in units of dry wt %.

Test 32 concerns pigment compositions comprised of the same "Alphacoat" kaolin suspended in the same concentration in water, plus a dispersant according to the invention, namely an acrylic polymer (specific viscosity 0.4) converted to salt form to the extent of 70% of the carboxyl groups by $Ca^{++}$ and 30% of the carboxyl groups by $Na^+$, which was introduced into the compositions in a series of increasing amounts.

The pH of these compositions was controlled at $7.1 \pm 0.1$

Figure 3:
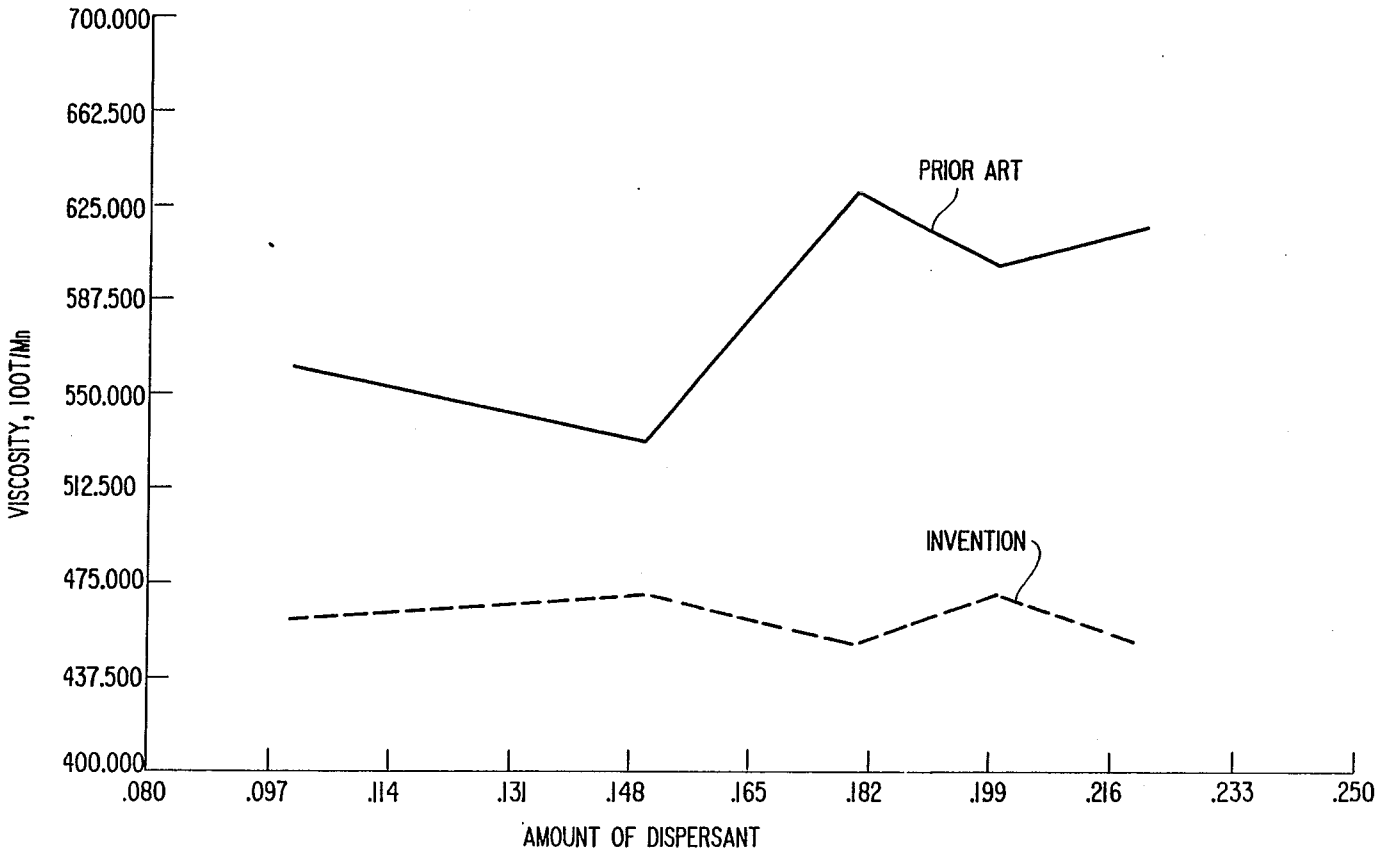
FIG. 3 shows the viscosity behavior of pigment compositions employing kaolin with respect to increasing amounts of dispersant at a given pH value.

The Brookfield viscosities of all these pigment compositions were measured. The results are given in Table V and FIG. 3.

TABLE V

| Test No. | Rpm of Brookfield viscometer | | Tabulated data are Brookfield viscosities (centipoise) Amount of dispersant used, dry wt. % (based on dry weight of pigments) 0.10% | 0.15% | 0.18% | 0.20% | 0.22% |
|---|---|---|---|---|---|---|---|
| Test 31 | 10 T/mn | 2,500 | 2,550 | 3,000 | 2,300 | 2,850 | |
| Prior Art | 100 T/mn | 560 | 530 | 630 | 600 | 615 | |
| Test 32 | 10 T/mn | 1,850 | 1,900 | 1,850 | 2,400 | 2,300 | |
| Invention | 100 T/mn | 460 | 470 | 450 | 470 | 450 | |

Table V confirms the conclusions derived from Table 1 (which concerns a Dinkie A lump kaolin).

Test 33 concerns pigment compositions comprised of the same "Alphacoat" kaolin in water suspension in the same (68 wt. %) concentration, and further comprised of a prior art dispersant which is the same as that of Test 31, which is introduced into the compositions in a dry weight concentration of 0.25 wt. % (based on the dry weight of the pigment). The pH of the compositions is varied in a series ranging from 6.7 to 10.25.

Test 34 concerns pigment compositions comprised of the same "Alphacoat" kaolin in water suspension in the same (68 wt. %) concentration, and further comprised of a dispersant according to the invention which is the same calcium/sodium polyacrylate as that of Test 32, which is introduced into the compositions in a dry weight concentration of 0.25 wt. % (based on the dry weight of the pigment). The pH of the compositions is varied in a series ranging from 6.5 to 10.0.

Figure 4:
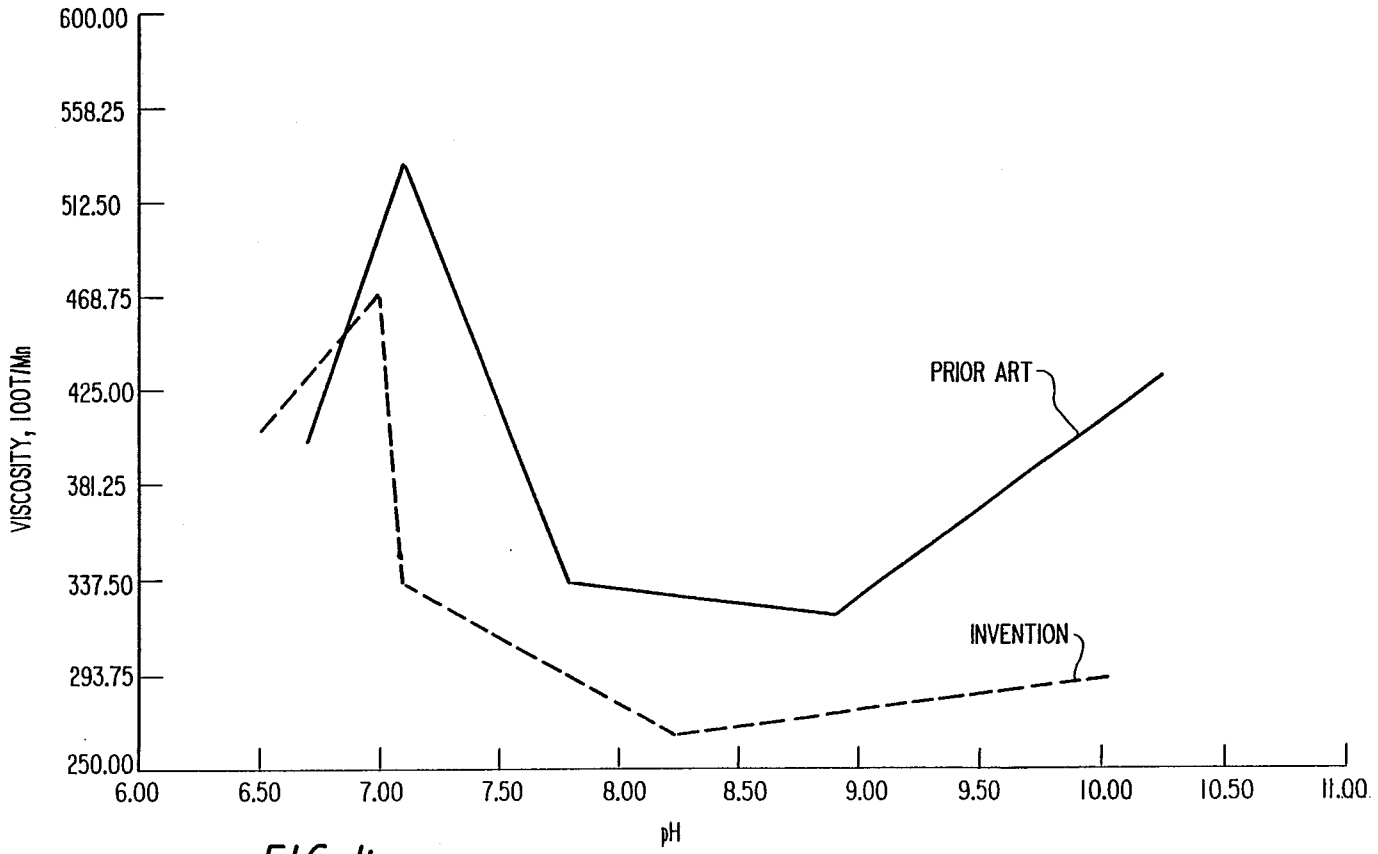
FIG. 4 shows the viscosity behavior of kaolin containing pigment compositions containing a known amount of dispersant with respect to changing pH values.

The results for these pigment compositions are given in Table VI and FIG. 4.

TABLE VI

| Test No. | Rpm of Brookfield viscometer | Tabulated data are Brookfield viscosities (centipoise) | | | | | |
|---|---|---|---|---|---|---|---|
| | | pH | | | | | |
| | | 6.7 | 7.1 | 7.8 | 8.9 | 9.4 | 10.25 |
| Test 33 | 10 T/mn | 1,650 | 2,550 | 1,400 | 1,400 | 1,650 | 2,100 |
| Prior Art | 100 T/mn | 400 | 530 | 335 | 320 | 360 | 430 |
| | | pH | | | | | |
| | | 6.5 | 7.0 | 7.1 | 8.25 | 8.8 | 10.0 |
| Test 34 | 10 T/mn | 1,650 | 1,900 | 1,300 | 1,000 | 1,050 | 1,150 |
| Invention | 100 T/mn | 405 | 470 | 335 | 265 | 275 | 290 |

Table VI provides grounds for the same conclusions as Table II (which concerns a Dinkie A lump kaolin).

EXAMPLE 5

This Example illustrates the invention in comparison to the prior art. The Example concerns preparation of pigment compositions for coating paper, making use of dispersants comprising acrylic polymers with specific viscosity 0.4 (measured on the sodium salt).

Tests 35 and 37 concern aqueous pigment compositions for coating paper, comprised of a natural calcium carbonate (supplied by Omya; BET specific surface 7 $m^2/g$—Test 35) or of a precipitated calcium carbonate ("Socal P3" supplied by Solvay; BET specific surface 14 $m^2/g$—Test 37), in the presence of a dispersant, i.e., the above-described acrylic polymer, which is completely converted to salt form by sodium ion, as per the prior art.

Tests 36 and 38 concern aqueous pigment compositions for coating paper according to the invention which are comprised of the same calcium carbonates as used in Tests 35 and 37, respectively, in the presence of a dispersant i.e., the above-described acrylic polymer, which is converted to salt form to the extent of 70% of the carboxyl groups by $Ca^{++}$ and to the extent of 30% by $Na^{+}$.

The results for these compositions are given in Table VII.

Comparison of the prior art tests (Tests 35 and 37) with the tests according to the invention (Tests 36 and 38) confirms the important benefits obtained from the invention, particularly when there is a substantial increase in the BET specific surface of the pigments. It is clear that high surface area leads to problems which are familiar in the art.

TABLE VII

| Test No. | Type of mineral pigment | Dispersant (acrylic polymer): Salt-forming agent | Dispersant (acrylic polymer): Degree of conversion to salt form (1 = 100%) | Weight Percent: Amount of Dispersent (dry wt. % based on dry weight of pigment) | Weight Percent: Amount of Pigment (wt. % based on the total weight of the aqueous pigment suspension) | Viscosity (centipoise) of the pigment composition: At 10 rpm (of viscometer) | Viscosity (centipoise) of the pigment composition: At 100 rpm (of viscometer) |
|---|---|---|---|---|---|---|---|
| Test 35 Prior Art | Natural calcium carbonate | $Na^{+}$ | 1.0 | 0.25 | 73 | 1,150 | 300 |
| Test 36 Invention | | $Ca^{2+}/Na^{+}$ | 0.7/0.3 | 0.25 | 73 | 1,100 | 290 |
| Test 37 Prior Art | Precipitated calcium carbonate | $Na^{+}$ | 1.0 | 0.80 | 68 | 1,000 | 300 |
| Test 38 Invention | | $Ca^{2+}/Na^{+}$ | 0.7/0.3 | 0.80 | 68 | 300 | 170 |

EXAMPLE 6

This example illustrates the use of a dispersant according to the invention in an aqueous pigment composition, which is an acrylic polymer (specific viscosity 0.4) partially converted to the salt form by $Ca^{++}$ (to the extent of 70% of the carboxyl groups), with the remaining —COOH groups being unconverted.

In this connection, Test 39 concerns preparation of an aqueous pigment composition comprising $TiO_2$ in the amount of 72 wt. % (based on the total weight of the pigment composition suspension), the $TiO_2$ being the product "Anatase" of the firm Thann et Mulhouse,. The pigment composition further comprises a dispersant (the above-described acrylic polymer, but with $Ca^{++}$/—COOH=0.7/0.3) which is present in the amount of 0.35 wt. % (based on the dry weight of the pigment).

The results for this composition and for the comparison composition (the prior art Test 5) are given in Table VIII.

TABLE VIII

| Test No. | Dispersant (acrylic polymer): Salt-forming agent | Dispersant (acrylic polymer): Degree of conversion to salt form (1 = 100%) | Viscosity (centipoise) of the pigment compositions: At 10 rpm (of viscometer | Viscosity (centipoise) of the pigment compositions: At 100 rpm (of viscometer) |
|---|---|---|---|---|
| Test 5 Prior Art | Na | 1 | Not measureable - composition too thick | |
| Test 39 Invention | $Ca^{2+}$/—COOH | 0.7/0.3 | 5,000 | 780 |

Thus, as long as the dispersant (acrylic polymer) is converted to salt form to the extent of at least 60% of the carboxyl groups by a salt-forming agent having a polyvalent function, the presence of free carboxylic acid groups does not detract from the beneficial effects noticed for the pigment compositions according to the invention.

EXAMPLE 7

The object of this Example is comparison of complex pigment compositions for coating paper, namely, compositions comprising mixtures of two components, according to the prior art and according to the invention.

Complex pigment compositions were prepared, by known methods, in which the dispersant was, in one case, a known type (sodium polyacrylate), and in the other case a polymer converted to salt form according to the invention, namely, converted to salt form to the extent of 70% of the carboxyl groups by $Ca^{++}$ and to the extent of 30% by $Na^{+}$.

Test 40 concerns a complex pigment composition according to the prior art, comprised of the following:

(1) Dinkie A lump kaolin in the amount of 70 wt. %, introduced in the form of an aqueous suspension comprised of the kaolin in the amount of 71 wt. % of the suspension, and containing a dispersant in the form of a sodium polyacrylate (specific viscosity 0.4; completely converted to salt form), the dispersant being present in the amount of 0.25 wt. % (dry basis, based on the dry weight of the kaolin); and (2) calcium carbonate pigment in the amount of 30 wt. %, introduced in the form of an aqueous suspension comprised of the calcium carbonate in the amount of 74.3 wt. % of the suspension, and containing a dispersant in the form of an acrylic polymer (specific viscosity 0.56; converted to salt form to the extent of 30% of the carboxyl groups by $Ca^{++}$ and to the extent of 70% by $Na^{+}$, according to the prior art) the dispersant being present in the amount of 0.6 wt. % (dry basis, based on the dry weight of the calcium carbonate).

Test 41 concerns a complex pigment composition according to the invention, comprised of the following:

(1) Dingie A lump kaolin in the amount of 70 wt. %, introduced in the form of an aqueous suspension comprised of the kaolin in the amount of 71 wt. % of the suspension, and containing a dispersant in the form of an acrylic polymer (specific viscosity 0.4; converted to salt form to the extent of 70% of the carboxyl groups by $Ca^{++}$ and to the extent of 30% by $Na^{+}$). The dispersant was present in the amount of 0.25 wt. % (dry basis, based on the dry weight of the kaolin); and (2) calcium carbonate pigment in the amount of 30 wt. %, introduced in the form of an aqueous suspension as per Test 40.

Pigment compositions for coating paper were prepared by adding the following to the mixtures of Test 40 (prior art) and Test 41 (invention), per 100 parts by weight of dry pigment:

0.5 parts by weight of a water retention agent (carboxymethylcellulose); and 10.5 parts by weight of a latex, namely an anionic aqueous emulsion of an acrylic copolymer having trade name "Acronal S 360 D®", supplied by BASF.

The pH of these coating compositions was controlled at 8.6±1. The dry matter concentration was 69 wt. %.

The Brookfield viscosities of the coating compositions were measured at 10 and 100 rpm, under appropriate forces.

All the results for these compositions are given in Table IX.

TABLE IX

| Test No. | Brookfield viscosity (centipoise) At 10 rpm (of the viscometer) | At 100 rpm (of the viscometer) |
|---|---|---|
| Test 40 Prior Art | 16,600 | 2,880 |
| Test 41 Invention | 11,000 | 1,900 |

Table IX, showing the comparison between the two paper-coating compositions, confirms that at equal concentrations of pigments and dispersants the viscosity of the inventive paper-coating composition is always much lower (by about 40%) than that of the coating composition according to the prior art.

EXAMPLE 8

This Example is a comparison of complex pigment compositions for coatin paper, namely, compositions comprising mixtures of three components, according to the prior art and according to the invention. Complex pigment compositions were prepared, by known methods, in which the dispersants were, in one group of cases, prior art types, and in the other group of cases the dispersants were polymers converted to salt form according to the invention.

Test 42 concerns a complex composition according to the prior art, prepared by combining the following ingredients:

(a) titanium dioxide ("Anatase At1", supplied by the firm Thann et Mulhouse) in the amount of 10 wt. % of the composition, introduced in the form of an aqueous suspension of which the titanium dioxide comprises 72 wt. %. The suspension also contains a dispersant in the form of sodium polyacrylate (specific viscosity 0.4; degree of conversion to the salt form 100% of the carboxyl groups), the dispersant being present in the amount of 0.1 wt. % (dry basis, based of the dry weight of the titanium dioxide);

(b) then, calcium carbonate pigment in the amount of 20 wt. % of the composition, introduced in the form of the aqueous suspension employed in Test 40, with the prior art dispersant; and (c) then, kaolin in the amount of 70 wt. % of the composition, introduced in the form of the aqueous suspension employed in Test 40, with the prior art dispersant.

Test 43 concerns a complex composition according to the invention, prepared by combining the following ingredients:

(a) titanium dioxide ("Anatase At1", supplied by the firm Thann et Mulhouse) in the amount of 10 wt. % of the composition, introduced in the form of an aqueous suspension of which the titanium dioxide comprises 72 wt. %. The suspension also contains a dispersant according to the invention, in the form of an acrylic polymer (specific viscosity 0.4 as measured on the sodium salt; converted to the salt form to the extent of 70% of the carboxyl groups by $Ca^{++}$ and to the extent of 30% by $Na^{+}$) in the amount of 0.35 wt. % (dry basis, based on the dry weight of the titanium dioxide);

(b) then, calcium carbonate pigment in the amount of 20 wt. % of the composition, introduced in the form of the aqueous suspension employed in Test 42 (paragraph (b) thereof); and (c) then, kaolin in the amount of 70 wt. % of the composition, introduced in the form of the aqueous suspension employed in Test 42 (paragragh (c) thereof).

Test 44 concerns a complex composition according to the invention, prepared by combining the following ingredients:

(a) titanium dioxide ("Anatase At1", supplied by the firm Thann et Mulhouse) in the amount of 10 wt. % of the composition, introduced in the form of an aqueous suspension of which the titanium dioxide comprises 72 wt. %. The suspension also contains a dispersant according to the invention, in the form of an acrylic polymer (specific viscosity 0.4 as measured on the sodium salt; converted to the salt form to the extent of 70% of the carboxyl groups by $Ca^{++}$ and to the extent of 30% by $Na^{+}$) in the amount of 0.35 wt. % (dry basis, based on the dry weight of the titanium dioxide);

(b) then, calcium carbonate pigment in the amount of 20 wt. % of the composition, introduced in the form of the aqueous suspension employed in Test 42, with the dispersant according to the prior art; and (c) then, kaolin in the amount of 70 wt. %, introduced in the form of an aqueous suspension comprised of the kaolin in the amount of 71 wt. % of the suspension, and containing a dispersant in the form of an acrylic polymer (specific viscosity 0.4; converted to salt form to the extent of 70% of the carboxyl groups by $Ca^{++}$ and to the extent of 30% by $Na^{+}$) in the amount of 0.25 wt. % (dry basis, based on the dry weight of the kaolin).

Test 45 concerns a complex composition according to the prior art, prepared by combining the following ingredients:

a kaolin in the amount of 70 wt. % of the composition, introduced in the form of the aqueous suspension employed in Test 40, with the prior art dispersant;

(b) then, calcium carbonate pigment in the amount of 20 wt. % of the composition, introduced in the form of the aqueous suspension employed in Test 40, with the prior art dispersant; and (c) then, titanium dioxide ("Anatase At1", supplied by the firm Thann et Mulhouse) in the amount of 10 wt. % of the composition, introduced in the form of an aqueous suspension of which the titanium dioxide comprises 72 wt. %. The suspension also contains a dispersant in the form of sodium polyacrylate (specific viscosity 0.4; degree of conversion to the salt form 100% of the carboxyl groups). The dispersant is present in the amount of 0.1 wt. % (dry basis, based on the dry weight of the titanium dioxide).

Test 46 concerns a complex composition according to the invention, prepared by combining the following ingredients:

(a) kaolin in the amount of 70 wt. % of the composition, introduced in the form of the aqueous suspension employed in Test 40, with the prior art dispersant;

(b) then, calcium carbonate pigment in the amount of 20 wt. % of the composition, introduced in the form of the aqueous suspension employed in Test 40, with the prior art dispersant; and (c) then, titanium dioxide ("Anatase At1", supplied by the firm Thann et Mulhouse) in the amount of 10 wt. % of the composition, introduced in the form of an aqueous suspension of which the titanium dioxide comprises 72 wt. %. The suspension also contains a dispersant according to the invention, in the form of an acrylic polymer (specific viscosity 0.4 as measured on the sodium salt; converted to the salt form to the extent of 70% of the carboxyl groups by $Ca^{++}$ and to the extent of 30% by $Na^{+}$) in the amount of 0.35 wt. % (dry basis, based on the dry weight of the titanium dioxide).

Test 47 concerns a complex composition according to the invention, prepared by combining the following ingredients:

(a) kaolin in the amount of 70 wt. %, introduced in the form of an aqueous suspension comprised of the kaolin in the amount of 71 wt. % of the suspension, and containing a dispersant in the form of an acrylic polymer (specific viscosity 0.4; converted to the salt form to the extent of 70% of the carboxyl groups by $Ca^{++}$ and to the extent of 30% by $Na^{+}$) in the amount of 0.25 wt. % (dry basis, based on the dry weight of the kaolin);

(b) then, calcium carbonate pigment in the amount of 20 wt. % of the composition, introduced in the form of the aqueous suspension employed in Test 40, with the dispersant according to the prior art; and (c) then, titanium dioxide ("Anatase At1", supplied by the firm Thann et Mulhouse) in the amount of 10 wt. % of the composition, introduced in the form of an aqueous suspension of which the titanium dioxide comprises 72 wt. %. The suspension also contains a dispersant according to the invention, in the form of an acrylic polymer (specific viscosity 0.4 s measured on the sodium salt; converted to the salt form to the extent of 70% of the carboxyl groups by $Ca^{++}$ and to the extent of 30% by $Na^{+}$) in the amount of 0.35 wt. % (dry basis, based on the dry weight of the titanium dioxide).

After the above various pigment-containing mixtures were prepared, corresponding compositions for the coating of paper were prepared by adding the following to the mixtures of Tests 42 to 47, per 100 parts by weight of dry pigment:

0.5 parts by weight of a water retention agent (carboxymethylcellulose); and 10.5 parts by weight of the latex described in Example 7, above.

The pH of these compositions was controlled at 8.6±0.1, and the concentration of dry matter was controlled at 68.7±0.2%.

The Brookfield viscosities of the coating compositions thus prepared were measured, at 10 and 100 rpm.

All the results relating to these compositions are given in Table X.

From Table X, and by comparison of the tests concerning the prior art and the tests concerning the invention, it is seen that:

(a) With regard to the prior art: The order of addition of the aqueous pigment suspensions when preparing the complex compositions for coating of paper is important. It can give rise to setting (Test 42) or very high viscosity of the composition (Test 45). This indicates incompatibility of the various pigments.

(b) With regard to the invention: The aqueous pigment suspensions produced in the presence of at least one dispersant according to the invention are compatible among themselves when mixed, due to the presence of the inventive dispersant. Regardless of the order of mixing of the pigment suspensions, the mixtures do not set or congeal; rather, they impart much lower viscosities to the complex compositions thus prepared than result under the prior art.

TABLE X

| Test No. | Brookfield viscosity (centipoise) At 10 rpm (of the viscometer) | At 100 rpm (of the viscometer) |
|---|---|---|
| Test 42 Prior Art | SETTING | |
| Test 43 Invention | 11,400 | 1,920 |
| Test 44 Invention | 9,600 | 1,720 |
| Test 45 Prior Art | 14,000 | 2,400 |
| Test 46 Invention | 9,800 | 1,680 |
| Test 47 Invention | 9,200 | 1,560 |

Obviously, numerous modifications and variations of the present invention are possible in light of the above teachings. It is therefore to be understood that within the scope of the appended claims, the invention may be practiced otherwise than as specifically described herein.

We claim:

1. A complex pigment composition for the coating of paper, comprising a dispersion of:

(i) an aqueous phase;

(ii) at least one pigment of mineral origin;

(iii) a binding agent; and (iv) a dispersing agent in an amount of 0.10–1.5 wt. % based on the weight of the dry pigment comprised of a corboxyl-containing polymer which is water soluble and converted to the salt form, wherein said dispersing agent has a specific viscosity of between 0.25 and 2.0, and wherein said dispersing agent is converted to the salt form to the extent of at least 60% by at least one salt-forming agent which has a polyvalent function.

2. The pigment composition of claim 1, wherein said dispersing agent results from the polymerization or copolymerization of at least one monomer selected from the group consisting of (meth)acrylic acid, itaconic acid, crotonic acid, fumaric acid, maleic anhydride, isocrotonic acid, aconitic acid, mesaconic acid, sinapic acid, undecylenic acid, angelic acid, and hydroxyacrylic acid.

3. The pigment composition of claim 2, wherein said dispersing agent rsults from copolymerization of said monomer with at least one comonomer selected from the group consisting of acrolein, acrylamide, acrylonitrile, esters of (meth)crylic acid, imidazoles, vinylpyrrolidone, vinylcaprolactam, ethylene, propylene, isobutylene, diisobutylene, vinyl acetate, styrene, alpha-methylstyrene, and methyl vinyl ketone.

4. The pigment composition of claim 3, wherein said ester of (meth)acrylic acid is methyl (meth)acrylate, ethyl (meth)acrylate, propyl (meth)acrylate, or dimethylaminoethyl (meth)acrylate.

5. The pigment composition of claim 2, wherein said dispersing agent results from the polymerization or copolymerization of at least one monomer selected from the group consisting of (meth)acrylic acid, itaconic acid, crotonic acid, fumaric acid, and maleic anhydride.

6. The pigment composition of claim 1, wherein said dispersing agent has a specific viscosity of between 0.3 and 1.0.

7. The pigment composition of claim 1, wherein said salt-forming agent has a polyvalent function which is a divalent or trivalent cation.

8. The pigment composition of claim 7, wherein said cation is a member selected from the group consisting of calcium, magnesium, zinc, copper, lead, aluminum and chromium cations.

9. The pigment composition of claim 1, wherein the acid sites on said dispersing agent which are not converted to the salt form are preserved in the acid state.

10. The pigment composition of claim 9, wherein the acid sites of said dispersing agent which are not converted to the salt form are further converted to the salt form by a salt-forming agent having a monovalent function.

11. The pigment composition of claim 10, wherein said salt-forming agent having a monovalent function is selected from the group consisting of lithium, sodium, potassium, ammonium and quaternary amine cations.

12. The pigment composition of claim 1, wherein said dispersing agent is present in an amount of 0.15–1.0 wt. %.

13. The pigment composition of claim 1, wherein said pigment composition further comprises a binder or a water retention agent in an amount of 7–20 wt. % with respect to said pigment of mineral origin.

14. The pigment composition of claim 9, wherein said dispersing agent is present in the amount of 0.15–1.0 wt. %.

15. The pigment composition of claim 14, further comprising at least one additive selected from the group consisting of antifoaming agents, bluing agents, biocides, colorants, and alkaline hydroxides.

16. The pigment composition of claim 1, wherein said pigment of mineral origin is selected from the group consisting of kaolins, titanium oxides, talcs, natural or precipitated carbonates, aluminum hydroxides, the hydrated double sulfates of aluminum and calcium, and mixtures thereof.

17. The pigment composition of claim 1, wherein said binder or water retention agent is selected from the group consisting of starch, carboxymethylcellulose, polyvinyl alcohol, styrene-butadiene copolymers, and styrene-acrylate copolymers.

* * * * *

UNITED STATES PATENT AND TRADEMARK OFFICE

CERTIFICATE OF CORRECTION

PATENT NO. : 4,775,420

DATED : OCTOBER 4, 1988

INVENTOR(S) : OLIVIER GONNET ET AL

It is certified that error appears in the above-identified patent and that said Letters Patent is hereby corrected as shown below:

Abstract, last paragraph, change "titanium dioxode" to --titanium dioxide--.

Column 2, line 2, change "abovementioned" to --above-mentioned--.

Column 2, line 4, change "abovementioned" to --above-mentioned--.

Column 2, line 45, change "the viscosity and" to --the viscosity, and--.

Column 2, line 67, change "calclum carbonate" to --calcium carbonate--.

Column 3, line 66, change "withi the scope" to --within the scope--.

Column 10, Table III heading, change "At 10 rpm (of viscosimeter)" to --At 10 rpm (of viscometer)--.

Column 10, Table III heading, change "At 100 rpm (of viscosimeter)" to --At 100 rpm (of viscometer)--.

UNITED STATES PATENT AND TRADEMARK OFFICE

CERTIFICATE OF CORRECTION

PATENT NO. : 4,775,420

DATED : OCTOBER 4, 1988

INVENTOR(S) : OLIVIER GONNET ET AL

It is certified that error appears in the above-identified patent and that said Letters Patent is hereby corrected as shown below:

Column 10, line 67, change "abovedescribed" to --above-described--.

Columns 11-12, Table IV heading, change "dry weight (of pigment" to --dry weight) of pigment--.

Column 11, line 63, change "wt %." to --wt. %.--.

Column 12, line 33, change "7.1±0.1" to --7.1±0.1.--.

Column 12, Table V, each column of numbers should be re-aligned one column to the right so that they will fall into line under the appropriate column headings.

Columns 13-14, line 55, Table VII heading, change "Amount of Dispersent" to --Amount of Dispersant--.

Column 14, line 9, change "Mulhouse,." to --Mulhouse.--.

Column 14, line 23, Table VIII heading, change "At 10 rpm (of viscometer" to --At 10 rpm (of viscometer)--.

Column 14, line 24, change "Na" to --$Na^+$--.

Column 14, line 24, change "Not measureable" to --Not measurable--.

UNITED STATES PATENT AND TRADEMARK OFFICE

CERTIFICATE OF CORRECTION

PATENT NO. : 4,775,420

DATED : OCTOBER 4, 1988

INVENTOR(S) : OLIVIER GONNET ET AL

It is certified that error appears in the above-identified patent and that said Letters Patent is hereby corrected as shown below:

Column 15, line 21, change "Dingie" to --Dinkie--.

Column 15, line 68, change "for coatin paper" to --for coating paper--.

Column 16, line 12, change ""Anatase Atl"" to --"Anatase Atl"--.

Column 16, line 19, change "based of the dry" to --based on the dry--.

Column 17, line 12 change "a kaolin" to --(a) kaolin--.

Column 17, line 38, begin new paragraph with (c)

Column 17, line 65, change ""Anatase Atl"" to --"Anatase Atl"--.

Column 18, line 3, change "0.4 s measured" to --0.4 as measured--.

Column 19, line 4, change "corboxyl-containing" to --carboxyl-containing--.

UNITED STATES PATENT AND TRADEMARK OFFICE

CERTIFICATE OF CORRECTION

PATENT NO. : 4,775,420

DATED : OCTOBER 4, 1988

INVENTOR(S) : OLIVIER GONNET ET AL

It is certified that error appears in the above-identified patent and that said Letters Patent is hereby corrected as shown below:

Column 19, line 20, change "rsults" to --results--.

Signed and Sealed this

First Day of August, 1989

*Attest:*

*Attesting Officer*

DONALD J. QUIGG

*Commissioner of Patents and Trademarks*